US005233331A

United States Patent [19]

Comerford et al.

[11] Patent Number: 5,233,331

[45] Date of Patent: Aug. 3, 1993

[54] INKING BUFFER FOR FLAT-PANEL DISPLAY CONTROLLERS

[75] Inventors: Liam D. Comerford, Carmel; Lawrence I. Levy, Yorktown Heights, both of N.Y.

[73] Assignee: International Business Machines Corporation, Armonk, N.Y.

[21] Appl. No.: 642,481

[22] Filed: Jan. 17, 1991

[51] Int. Cl.[5] ..... G09G 3/02; G09G 1/02

[52] U.S. Cl. ..... 340/712; 340/799; 178/18

[58] Field of Search ..... 340/703, 706, 707, 710, 340/712, 799, 798, 709; 178/18; 368/41, 70, 71; 341/22; 364/41, 70, 71

[56] References Cited

U.S. PATENT DOCUMENTS

| | | | |
|---|---|---|---|
| 4,141,000 | 2/1979 | Thomas et al. | 340/752 |
| 4,317,114 | 2/1982 | Walker . | |
| 4,385,291 | 5/1983 | Piguet | 340/712 |
| 4,388,621 | 6/1983 | Komatsu et al. | 340/750 |
| 4,477,797 | 10/1984 | Nakagiri | 340/712 |
| 4,661,712 | 4/1987 | Ikeda | 340/750 |
| 4,730,186 | 3/1988 | Koga . | |
| 4,926,166 | 5/1990 | Fujisawa et al. | 340/717 |
| 5,056,057 | 10/1991 | Johnson et al. | 541/22 |

FOREIGN PATENT DOCUMENTS

| | | |
|---|---|---|
| 60-221875 | 6/1985 | Japan . |
| WO/9015380 | 12/1990 | PCT Int'l Appl. . |

*Primary Examiner*—Ulysses Weldon
*Assistant Examiner*—Amare Mengistu
*Attorney, Agent, or Firm*—Whitham & Marhoefer

[57] ABSTRACT

An intelligent subsystem separately supports inking functions in order to allow stroke-ignorant software to be supported in a stylus driven environment. This subsystem thus provides the inking capability missing in existing flat-panel display controllers. Separate inking functions are incorporated into the subsystem in order to support inking management functions which do not corrupt the display refresh buffer as it is understood by existing application software. The subsystem makes no assumptions about the application's awareness of stroke data as an input modality. Instead, the subsystem assumes that a conventional display subsystem also exists in the system. The subsystem utilizes the strobes and clocks generated by the conventional display controller to generate addresses in a memory which has physically separate address and strobe lines from the display refresh buffer. The content of this added memory is used to control the source of input to the data lines of the display. The invention can be generalized to allow any number of planes to be added to a display system providing access to that display system by any number of asynchronous processes such as inking.

10 Claims, 4 Drawing Sheets

INKING BUFFER FOR FLAT-PANEL DISPLAY CONTROLLERS

DESCRIPTION

Background of the Invention

1. Field of the Invention

The present invention generally relates to tablets used to provide handwriting data input and output (I/O) to computers by incorporating a digitizer and a flat panel display. Such an I/O device simulates "ink" from an electronic stylus to provide visual feedback to the operator. More specifically, the invention is directed to an apparatus which adds inking functions to existing flat-panel display controllers.

2. Description of the Prior Art

The use of handwriting input to computers relies on the transfer of the skill of handwriting from the domain of pen and paper to the domain of electronic styli and digitizer/flat-panel displays. The combination of a transparent or rear-mounted digitizer and a flat panel display, such as a liquid crystal display (LCD), has been used as a device for supporting user input to computers. The user input may be, for example, handwriting or freehand graphics. Typically, such displays are made to render a trace ("electronic ink") of the stylus path in order to aid the user in guiding the stylus. If the data representing the digitized stylus trace captured during hand writing is plotted, it is apparent that the quality of characters written on such a device is different than that produced by the same person when a pen or pencil is used on paper. This difference reflects the user's difficulty in transferring the handwriting skill to the electronic environment. What is needed is an improvement in the electronic environment to more closely resemble the physical paper environment so that the electronic environment will be more effective in supporting user-computer transactions.

One aspect of emulating a paper-and-pen environment for the user is the appearance of the "ink" on the electronic display as the user moves the electronic stylus on the display surface. This "ink" is a critical part of the process by which users successfully form computer "readable" characters. In the absence of the feedback which the inking provides, characters with defective structure are observed frequently and the effort required to produce characters of any given quality can be seen to increase. One form of "absence" of ink which appears in some systems is the delayed display of ink. In such systems, the ink seems to "chase" the stylus rather than flow from it. This has been observed to slow and, hence, distort handwriting.

Inking in an electronic notepad environment can be considered as consisting of two phases. The first is the trace of the stylus path on the screen. The second is the erasure of the first trace and the redisplay of the stroke data by stroke aware application software. Applications are aware of their display content and can manage their display content to reflect inking if that is desirable in the application's context. The stylus trace inking, on the other hand, must be shown to a user prior to the stroke data being interpreted or routed to an application. The subject invention is intended to satisfy that requirement.

U.S. Pat. No. 4,839,634 to More et al. discloses an electro-optic slate for input/output of textual and graphical information which comprises a combined flat panel display and pen sensing surface. However, the More et al. invention does not provide a general solution to the inking problem; rather, the More et al. solution rests on providing a set of resident applications which are written with full knowledge of inking requirements. The architecture used to support inking is identical to that used to support the application display, which is not different from support for random line drawing as it has appeared in graphics and computer aided drafting (CAD) application software. In the More et al. architecture, a single controller (the "Display Control") is used to provide a data path from the portion of memory used as a display refresh buffer to the display itself. This controller also provides the timing signals needed to strobe data into the display.

Also pertinent in the prior art is U.S. Pat. No. 4,794,634 to Torihata et al. which discloses a data input device comprising a combined stylus tablet and planar display. While Torihata et al. recognize the need for inking, their approach suffers from architectural limitations similar to those of the More et al. patent. The similarity can be seen by counting the number of data paths needed for the digitizer and display support processor. Both require four paths, including connections from the central processing unit (CPU) to the digitizer interface, to the memory, to the display driver, and to the remotely attached application. This is necessary because the tablet is not attached to the display refresh buffer of the application processor and must receive and store a duplicate of the buffer's contents. Both the buffered display and the ink data can reside in the same physical memory.

Of general interest in the prior art are U.S. Pat. No. 4,814,760 to Johnston et al., which discloses an information display and entry device, and U.S. Pat. No. 4,875,036 to Washizuka et al., which discloses a liquid crystal display unit allowing input of data by manual writing. However, neither of these address the inking problem.

SUMMARY OF THE INVENTION

It is therefore an object of the present invention to provide an intelligent subsystem that separately supports inking functions in order to allow stroke-ignorant software to be supported in a stylus driven environment.

It is another object of the invention to provide the inking capability missing in existing flat-panel display controllers.

According to the invention, separate inking functions are incorporated into an intelligent subsystem in order to allow stroke-ignorant software applications to be supported in a stylus driven environment by providing inking management functions which do not corrupt the display refresh buffer as it is understood by existing application software. The invention makes no assumptions about the application's awareness of stroke data as an input modality. Instead, the invention assumes that a conventional display subsystem also exists in the system. The invention utilizes the strobes and clocks generated by the conventional display controller to generate addresses in a memory which has physically separate address and strobe lines from the display refresh buffer. The content of this added memory is used to control the source of input to the data lines of the display. This display timing extraction of screen addresses, and memory content dependent routing of display input path is unique to the invention. The invention can be generalized to allow any number of planes to be added to a display system providing access to that display system by any number of asynchronous processes such as inking.

The subject invention is specifically concerned with the initial inking only. Up to now, electronic inking has been a very rare requirement in the computer market and, as a result, support for this function is universally absent from large scale integrated (LSI) display controller chips. Adding this function in a manner consistent with the development of portable electronic notebooks must be done within severe physical constraints of weight, volume, heat dissipation, and power consumption. The invention can be implemented as two chips (including memory) using CMOS gate array technology, thereby satisfying both the ergonomic requirement for inking and the implementation constraints of portable electronic notepad design.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
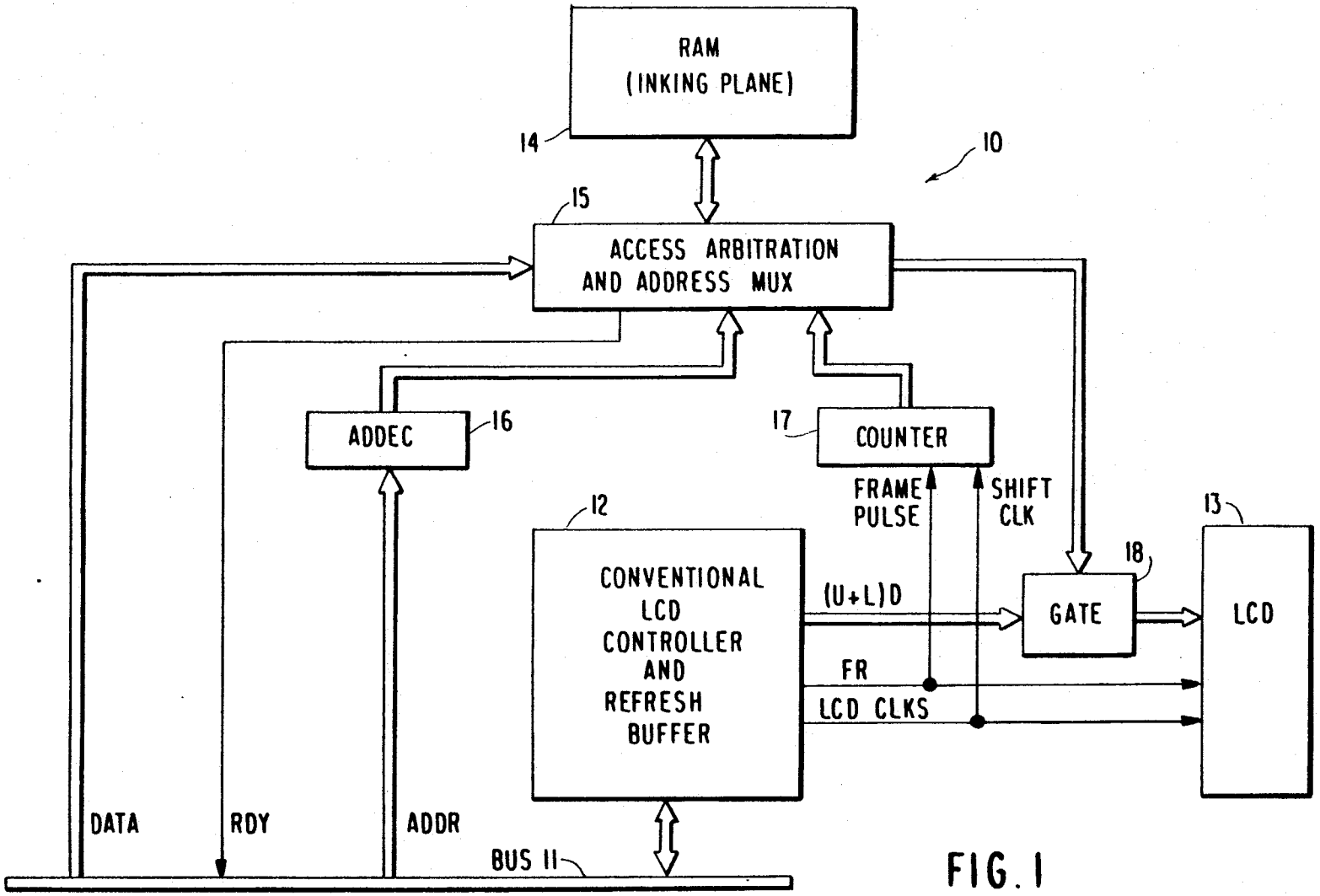
FIG. 1 is a block diagram showing an elementary stylus trace inking subsystem according to the invention.

Referring now to the drawings, and more particularly to FIG. 1, the stylus trace inking subsystem 10 according to the invention is shown as comprising five function blocks which work cooperatively to provide an additional plane for monochrome ink display on flat panel displays. The subsystem 10 is designed to connect to the bus 11 of an existing electronic notepad which also includes a digital display controller and refresh buffer 12 connected to a liquid crystal display (LCD) 13. The subsystem 10 includes a separate ink plane random access memory (RAM) 14, ink plane RAM access arbitration logic 15, an ink plane address decoder 16, an LCD refresh address counter 17, and an LCD refresh data gate 18.

More specifically, data is supplied from the bus 11 to the RAM 14 via the arbitration logic 15 in response to a ready (RDY) signal supplied by the arbitration logic. Ink data from the RAM 14 is in turn used to control data supplied to the LCD 13 via the data gate 18. The address (ADDR) at which data is stored in the RAM 14 is supplied from the bus 11 via decoder 16 to the arbitration logic 15. The address of data read out of RAM 14 for control of the LCD 13 input via the gate 18 is supplied by address counter 17 to the arbitration logic 15. The shift clock (CLK) and frame pulse inputs to the address counter 17 are supplied by the LCD controller 12.

The arbitration logic 15 provides read access to the RAM 14 based on the state of the counter 17 to the data gate 18 during any period that the LCD controller 12 is supplying a stream of refresh bits to the LCD 13, and the arbitration logic 15 provides write access to the RAM 14 for the bus 11 on the basis of the state of decoder 16 at all other times. The purpose of the arbitration logic 15 is to allow the ink buffer memory 14 to be updated by the central processing unit (CPU) (not shown) or other controlling device while another device, such as the inking gate 18, is using the memory. Collisions, or simultaneous access from multiple devices, result in address and data conflicts which would produce invalid or incorrect data accesses to the memory. Arbitration techniques to dual or multi-port memory systems are typically implemented with a simple multiplexer and gating circuits well known to those skilled in the art. Alternatively, there are commercially available two (or more) port RAMs, such as video RAMs (VRAMs), which contain internal arbitration and, therefore, do not require external arbitration logic.

In normal operation, with an LCD flat panel display, access to the memory 14 can be granted to a request for a write update at almost any time, as the disruption of the displayed ink is almost imperceptible. Such accesses are random and asynchronous, and flat panel displays usually have a poor response to one time events. In the case of multiple write requests, the requests have to be completely resolved and separated.

Bits in the ink plane RAM 14 are set to one or zero to indicate the presence or absence of "ink". At power on, a system software component (not part of the invention) initializes RAM 14 to whichever state indicates the absence of ink (i.e., INK=FALSE). The arbitration logic 15 provides two-port access to RAM 14.

The first port of RAM 14 is connected to the digitizer data stream. The data from the digitizer is transformed so that there is a mathematical correspondence between the digitizer data and the physically underlaying display picture elements. The data is then supplemented, where needed, with data to indicate picture elements which must have been traversed by the stylus when two non-contiguous points are found in sequential positions in the digitizer data stream. This data stream supplied via bus 11 is then written to the RAM 14.

The second port of the RAM 14 is addressed by the output of the LCD refresh address counter 17. This counter is reset to zero by the start of a frame signal (FR) from the LCD controller 12 and is incremented by the LCD clocks. The output of the counter 17 is used as an address to fetch a block of data from the inking plane RAM 14 which corresponds to the current refresh data being sent by the LCD controller 12 to the LCD panel 13. This data is typically 8-bits wide and is found on the lines marked (U+L)D on displays such as the Kyocera KL6448 family of display devices. Since this is a byte of data, a byte-wide memory is preferred for the ink plane RAM 14.

It should be understood that the video refresh signals sent by the LCD controller 12 to the LCD panel 13 do not change timing when video modes are changed so that these signals can be counted to obtain addresses which invariably map to the same set of pels on the panel. This mapping must be reflected in the software which utilizes the inking plane RAM 14 in order to place "ink" appropriately.

Figure 2:
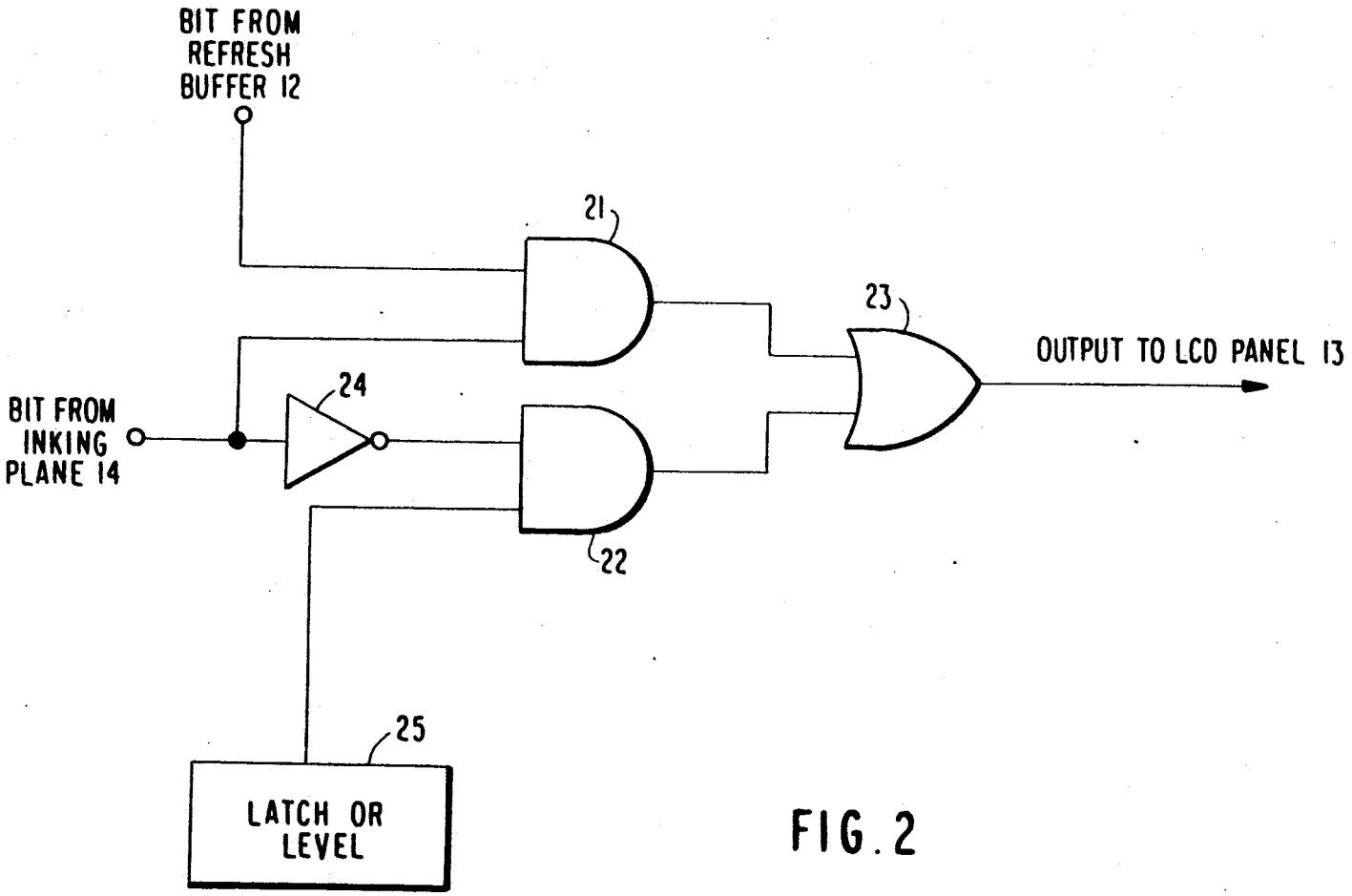
FIG. 2 is a block diagram showing video data gating to a liquid crystal display.

Ink data modifies the content of the display on a pel-by-pel basic through the refresh data gate 18, shown in more detail in FIG. 2. The data gate 18 may be implemented as a data selector, as shown, comprising a pair of AND gates 21 and 22 and an OR gate 23, there being eight such data selectors, one for each bit of the byte of data. Data from the inking plane RAM 14, which corresponds spatially to the video refresh data, is supplied directly to AND gate 21 and to AND gate 22 via invertor 24 to select either video refresh data from the refresh buffer 12 (i.e., INK=FALSE) or a constant bit from a latch 25 (i.e., INK=TRUE). The net effect of this circuit is to occlude (in black) the pels which are identified in the inking plane RAM 14 as inked. This action is performed in real-time as the ink data is fetched to the data gate 18 early in the period when the corresponding pel is being refreshed by the LCD controller 12. It should be understood that black ink is only one among many implementation choices. White, grey, inverse video, blanking, or, in color displays, colored ink can each be implemented through means obvious to those skilled in the art. Once ink is passed to a stylus-aware software application, it can be removed from the ink plane RAM 14 and redisplayed as needed by that application.

In one variation of the data selector, the state of the latch 25 can be switched on a time scale of a refresh for the LCD panel 13 to generate grey ink. The switching time scale corresponds to the grey scale produced. If desired, the system can be arranged to cause displayed pel inversion for the ink. This requires a slightly more complex data selector 18, but implementation is straight forward. Colored "ink" could also be supported using one of the newer color LCDs and, if the RAM 14 is composed of a plurality of planes, multiple colors could be simultaneously supported. For example, three inking planes could provide red, green and blue (RGB) inking data. It should be understood, however, that even a single ink plane can be used to control multiple ink gates.

Figure 3:
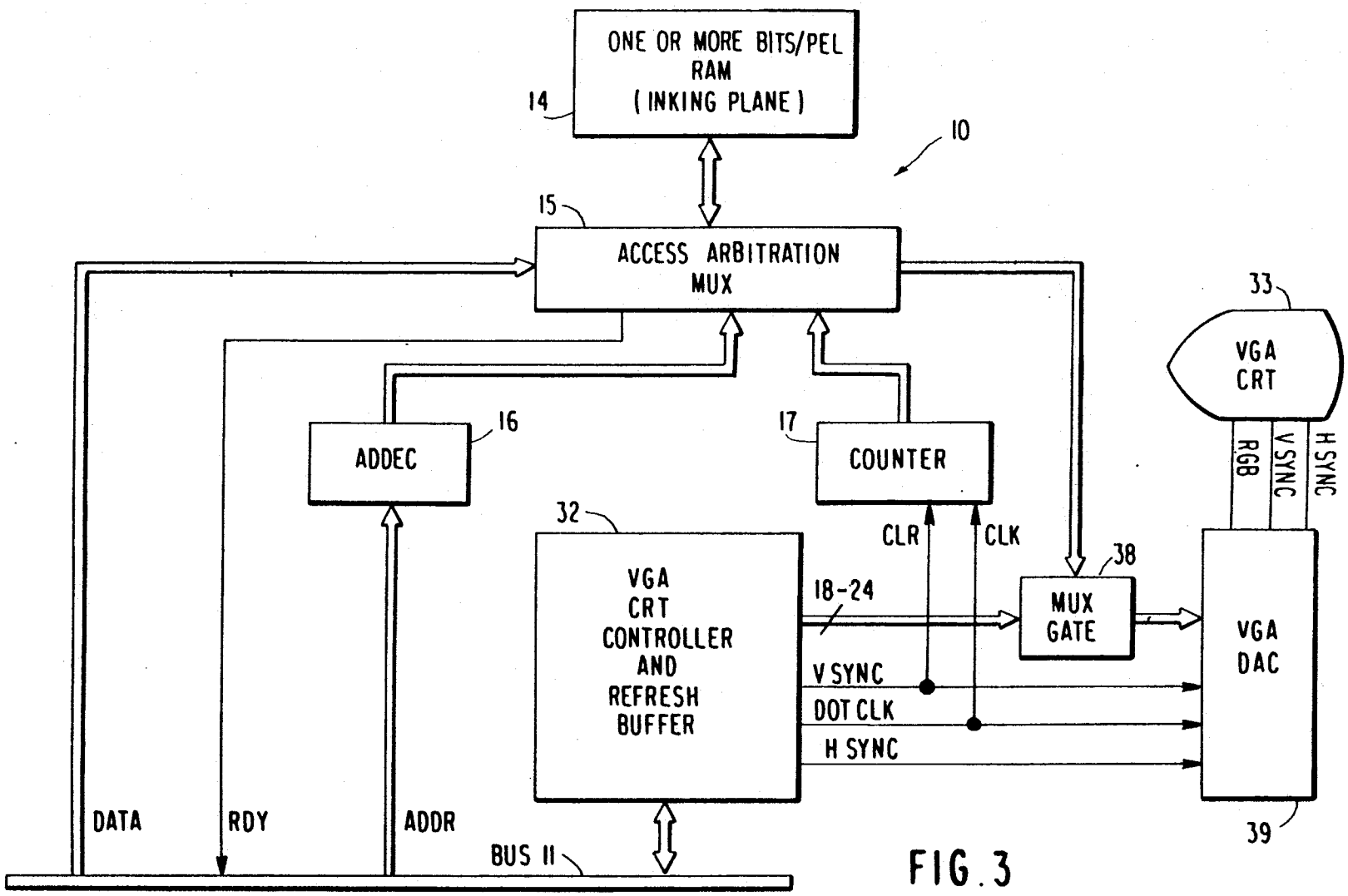
FIG. 3 is a block diagram, similar to FIG. 1, showing an alternative embodiment of the invention as applied to a cathode ray tube display.

The implementation of the ink gates, while usually used in a flat-panel LCD display, is also applicable to other types of raster displays, such as cathode ray tube (CRT) displays. FIG. 3 shows a modification of the structure of the connection to the display device for a video graphics array (VGA) type CRT display 33. In the case of a CRT display, the dot clocks are available on a standard IBM type VGA adapter 32 or at other available connecting points on the CRT controller interface. The format of the memory 14 is different, as each clock will the advance counter 17 one pel position, instead of eight pels (or four upper and four lower pels), as in the case of the flat panel LCD displays. Each plane therefore requires one bit/pel position address instead of the usual one byte for a normal LCD (although some LCD panels may have a different data format so the eight bits/address of the illustrative example is not an absolute value). The data from the ink plane 14 will control an ink gate multiplexer 38 the width of the data path to the digital-to-analog converter (DAC) 39, commonly 18 or 24 bits, but not limited to these values. The presence of a true value in the ink memory 14 at a pel position will change the value latched into the DAC 39 at the position (0, or black, for example) instead of the value that would have been delivered by the CRT controller 32. This will "ink" the display 33 without changing the contents of the CRT controller buffer. The principle may be applied to other types of display devices, such as flat panel electro-luminescent (EL) displays, digital CRT displays, such as color graphics adapter (CGA), enhanced graphics adapter (EGA), and the like, by similar techniques by intercepting the digital signal to the display device rather than the DAC.

Separate multiple inking planes also provide hardware support for implementing a full window system. An application program designed to run under a single tasking operating system could be given control of the screen refresh buffer without cutting the user off from contact with the operating system. Similarly, in a software debugging environment, code in test could execute with full command of the screen (from its point of view) while the debugger communicated with the user by writing messages in a two-level ink plane memory. A minimum of two levels are needed in both these cases so that an opaque background window can be created by one ink plane on which to write text and graphics from the other plane.

Figure 4:
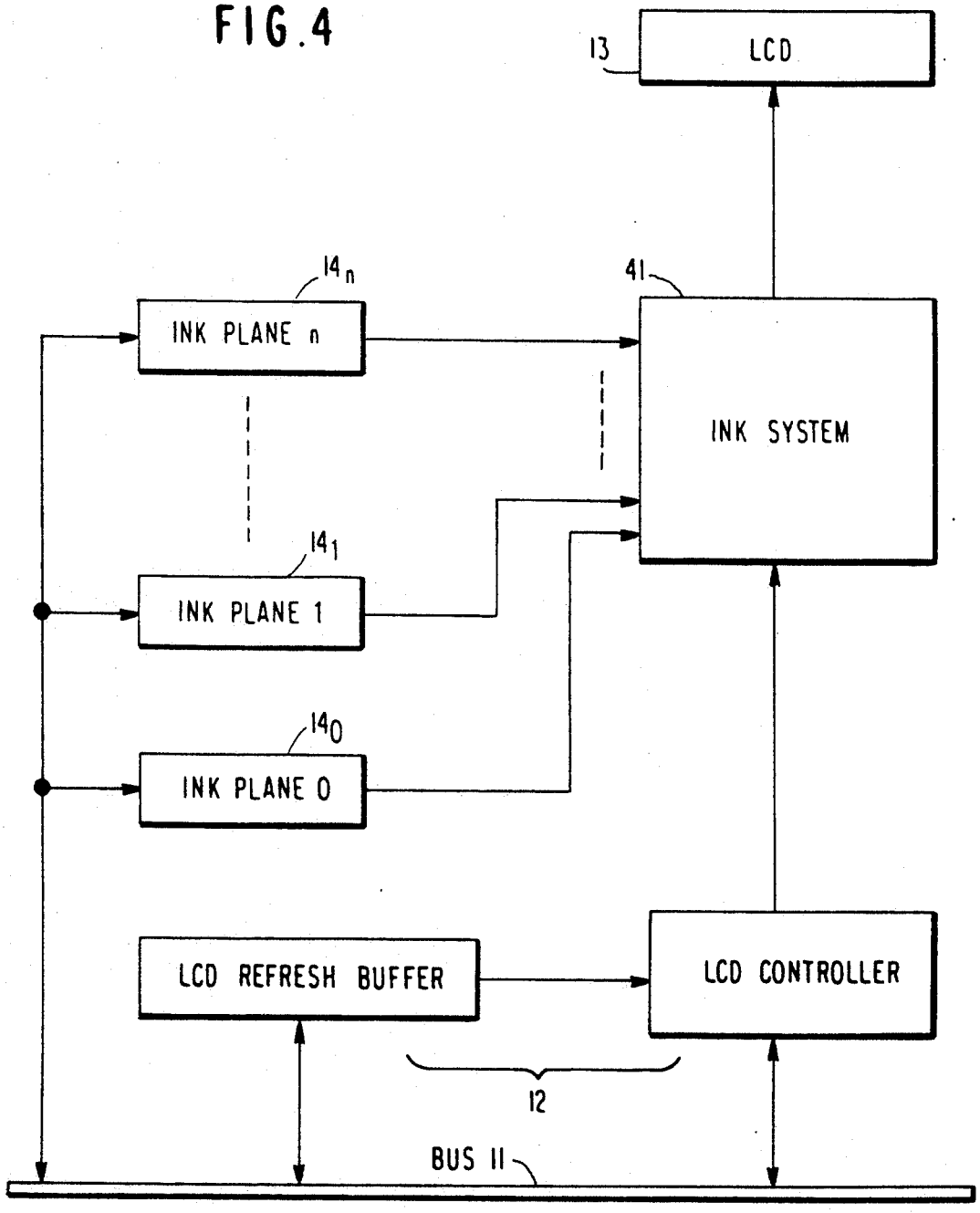
FIG. 4 is a block diagram showing a generalized example of a multi-plane system according to the invention.

FIG. 4 illustrates a generalized example of a multi-plane system. The diagram has been simplified to show data flow only. Elements concerned with control (e.g., address decoding, arbitration, counter, etc.) can be thought of as existing within appropriate blocks in this figure. As shown in FIG. 4, a plurality of inking planes $14_0$ to $14_n$ supply ink data to the inking system 41. The operation of the multi-plane system is best described by means of the following truth table.

| Plane State Ink Plane Number | | | | | Ink Gate Output |
|---|---|---|---|---|---|
| . . . | 3 | 2 | 1 | 0 | |
| | | | | | Hierarchical Gate |
| . . . | X | X | X | 1 | Plane 0 Levels |
| . . . | X | X | 1 | 0 | Plane 1 Levels |
| . . . | X | 1 | 0 | 0 | Plane 2 Levels |
| . . . | 1 | 0 | 0 | 0 | Plane 3 Levels |
| | . | | | | . |
| | . | | | | . |
| | . | | | | . |
| | | | | | Combinational Gate |
| . . . | 0 | 0 | 0 | 0 | Refresh Buffer Bits |
| . . . | 0 | 0 | 0 | 1 | Signal 1 |
| . . . | 0 | 0 | 1 | 0 | Signal 2 |
| . . . | 0 | 0 | 1 | 1 | Signal 3 |
| . . . | 0 | 1 | 0 | 0 | Signal 4 |
| | . | | | | . |
| | . | | | | . |
| | . | | | | . |

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. A computer display system comprising:

a display device;

refresh buffer means for supplying said display device with display data;

auxiliary display memory means physically separate from said refresh buffer means for storing alternate data to be displayed on said display device, said auxiliary display memory means comprising a plurality of memory planes;

means for supplying data to be written into said refresh buffer means and said auxiliary display memory means;

display controller means responsive to said means for supplying data for controlling said refresh buffer means;

decoder means responsive to said means for supplying data for generating an address for writing data in said auxiliary display memory means;

address counter means responsive to a clock signal from said display controller means for addressing said auxiliary display memory means to cause said auxiliary display memory means to cause said auxiliary data to be read out of said auxiliary display memory means;

arbitration means for allowing data to be written into said auxiliary display memory means according to an address supplied by said decoder means or data addressed by said address counter means to be read out of said auxiliary display memory means; and gating means responsive to data read out of said auxiliary display memory means for selectively supplying said display data from said refresh buffer means or said alternate data from said auxiliary display memory means to said display device, said gating means selecting data from among a plurality of alternate sources on the basis of the identity of the highest priority memory plane containing a bit indicating alternate source selection for each currently refreshing pel of the display.

2. The computer display system recited in claim 1 wherein said display system is a windowing display system and each of said memory planes stores alternate data for a different one of displayed windows.

3. The computer display system recited in claim 1 wherein said display device is a flat panel display device.

4. The computer display system recited in claim 1 wherein said display device is an analog cathode ray tube display device.

5. The computer display system recited in claim 1 wherein said display device is a digital cathode ray tube display device.

6. A computer display system comprising:

a display device;

refresh buffer means for supplying said display device with display data;

auxiliary display memory means physically separate from said refresh buffer means for storing alternate data to be displayed on said display device, said auxiliary display memory comprising a plurality of memory planes;

means for supplying data to be written into said refresh buffer means and said auxiliary display memory means;

display controller means responsive to said means for supplying data for controlling said refresh buffer means;

decoder means responsive to said means for supplying data for generating an address for writing data in said auxiliary display memory means;

address counter means responsive to a clock signal from said display controller means for addressing said auxiliary display memory means to cause said auxiliary display memory means to cause said auxiliary data to be read out of said auxiliary display memory means;

arbitration means for allowing data to be written into said auxiliary display memory means according to an address supplied by said decoder means or data addressed by said address counter means to be read out of said auxiliary display memory means; and gating means responsive to data read out of said auxiliary display memory means for selectively supplying said display data from said refresh buffer means or said alternate data from said auxiliary display memory means to said display device, said gating means selecting data from a plurality of alternate sources on the basis of the combination of states of bits in the memory planes corresponding to each currently refreshing pel of the display.

7. The computer display system recited in claim 6 wherein said display system is a windowing display system and each of said memory planes stores alternate data for a different one of displayed windows.

8. The computer display system recited in claim 6 wherein said display device is a flat panel display device.

9. The computer display system recited in claim 6 wherein said display device is an analog cathode ray tube display device.

10. The computer display system recited in claim 6 wherein said display device is a digital cathode ray tube display device.

* * * * *